US006009644A

United States Patent [19]

Hedley

[11] Patent Number: 6,009,644

[45] Date of Patent: Jan. 4, 2000

[54] TOOTH WEDGE ASSEMBLY

[75] Inventor: Robert Ian Hedley, New South Wales, Australia

[73] Assignee: Justoy Pty, Ltd, South Wales, Australia

[21] Appl. No.: 09/071,218

[22] Filed: May 1, 1998

[30] Foreign Application Priority Data

May 2, 1997 [AU] Australia ..... PO6579

[51] Int. Cl.[7] ..... E02F 9/28

[52] U.S. Cl. ..... 37/456

[58] Field of Search ..... 37/455, 456

[56] References Cited

U.S. PATENT DOCUMENTS

| | | | |
|---|---|---|---|
| 1,188,480 | 6/1916 | Pemberton | 37/455 |
| 1,548,374 | 8/1925 | Mullally | 37/455 |
| 1,571,782 | 2/1926 | Andrews | 37/455 X |
| 1,690,834 | 11/1928 | Ratkowski | 37/455 |
| 1,787,695 | 1/1931 | McKee | 37/455 |
| 1,835,288 | 12/1931 | Dyrr | 37/455 X |
| 1,870,044 | 8/1932 | Fellmeth | 37/455 |
| 1,917,431 | 7/1933 | Clark | 37/455 |
| 5,410,826 | 5/1995 | Immel et al. | 37/455 X |
| 5,438,774 | 8/1995 | Fletcher et al. | 37/455 X |
| 5,452,529 | 9/1995 | Neuenfeldt et al. | 37/455 |
| 5,465,512 | 11/1995 | Livesay et al. | 37/455 X |
| 5,564,206 | 10/1996 | Ruvang | 37/455 X |
| 5,784,813 | 7/1998 | Balassa et al. | 37/455 |

*Primary Examiner*—Christopher J. Novosad
*Attorney, Agent, or Firm*—Ladas & Parry

[57] ABSTRACT

A wedge assembly (10) to cooperate with a wedge element (11) to secure a tooth (12) to the projection (13) of a bucket of an earth-moving machine or ripper. The assembly (10) includes a pair of wedge halves (22, 23) which have external wedge surfaces (24, 25) which converge towards an end (21) of the assembly (10). Located internally of the wedge halves (22, 23) is a wedge member (33) having external converging wedge surfaces (24, 25) which engage converging internal wedge surfaces (30, 31) of the wedge halves. The wedge member (23) has a threaded end (38) which can be engaged by a "puller" to aid in moving the wedge member (33) to release the pressure on the wedge halves (22, 23) to facilitate removal of the wedge assembly (10) from engagement with the wedge element (11).

16 Claims, 3 Drawing Sheets

TOOTH WEDGE ASSEMBLY

TECHNICAL FIELD

The present invention relates to tooth wedge assemblies which are used on ground engaging equipment such as the buckets of earth moving equipment and rippers.

BACKGROUND OF THE INVENTION

Various systems have been used to secure a tooth to a supporting structure of a bucket or ripper. For example, cooperating wedges are driven into the aperture of a tooth, with the aperture being aligned with an aperture in a projection of the bucket or ripper. These previously available wedges have several disadvantages. Fur example, a is necessary to use a hammer to remove the wedges. It is not uncommon for pieces of metal to fracture from the wedges during impact. These pieces can result in eye and other injuries. A still further disadvantage is that the wedges are frequently hard to remove.

The above problems have been addressed by employing threshold shafts. These have also demonstrated disadvantages in that the threads are often deformed and become worn as the tooth passes through a soil or rock layer. This then makes the wedge difficult to remove.

OBJECTS OF THE INVENTION

It is the object of the present invention to overcome or substantially ameliorate at least one of the above discussed disadvantages.

SUMMARY OF THE INVENTION

There is disclosed herein an elongated wedge assembly to secure a tooth to a projection of a machine, the tooth having an aperture to be aligned with an aperture of the projections so that the tooth is secured to the projection by the wedges assembly being located in the aligned apertures, said wedge assembly comprising:

a pair of elongated wedge halves which cooperates to provide a longitudinally extending internal cavity between the wedge halves, the wedge halves providing two longitudinally extending internal surfaces defining said cavity which internal surfaces converge toward one end of said assembly, said wedge halves further providing a pair of longitudinally extending external wedge surfaces which also converge towards the end;

an internal wedge member extending longitudinally of said cavity, said wedge member having wedge surfaces converging towards said end and cooperating with the converging internal surfaces defining said cavity, said wedge member having a threaded end remote from said end of said cavity to enable gripping of said wedge member to move the wedge member longitudinally in a direction away from said end to enable relative movement of the wedge halves toward each other to facilitate removal of the wedge assembly from engagement with the tooth and projection.

BRIEF DESCRIPTION OF THE DRAWINGS

A preferred from of the present invention will now be described by way of example with reference to the accompanying drawings wherein.

DETAILED DESCRIPTION OF THE PREFERRED EMBODIMENT

Figure 1:
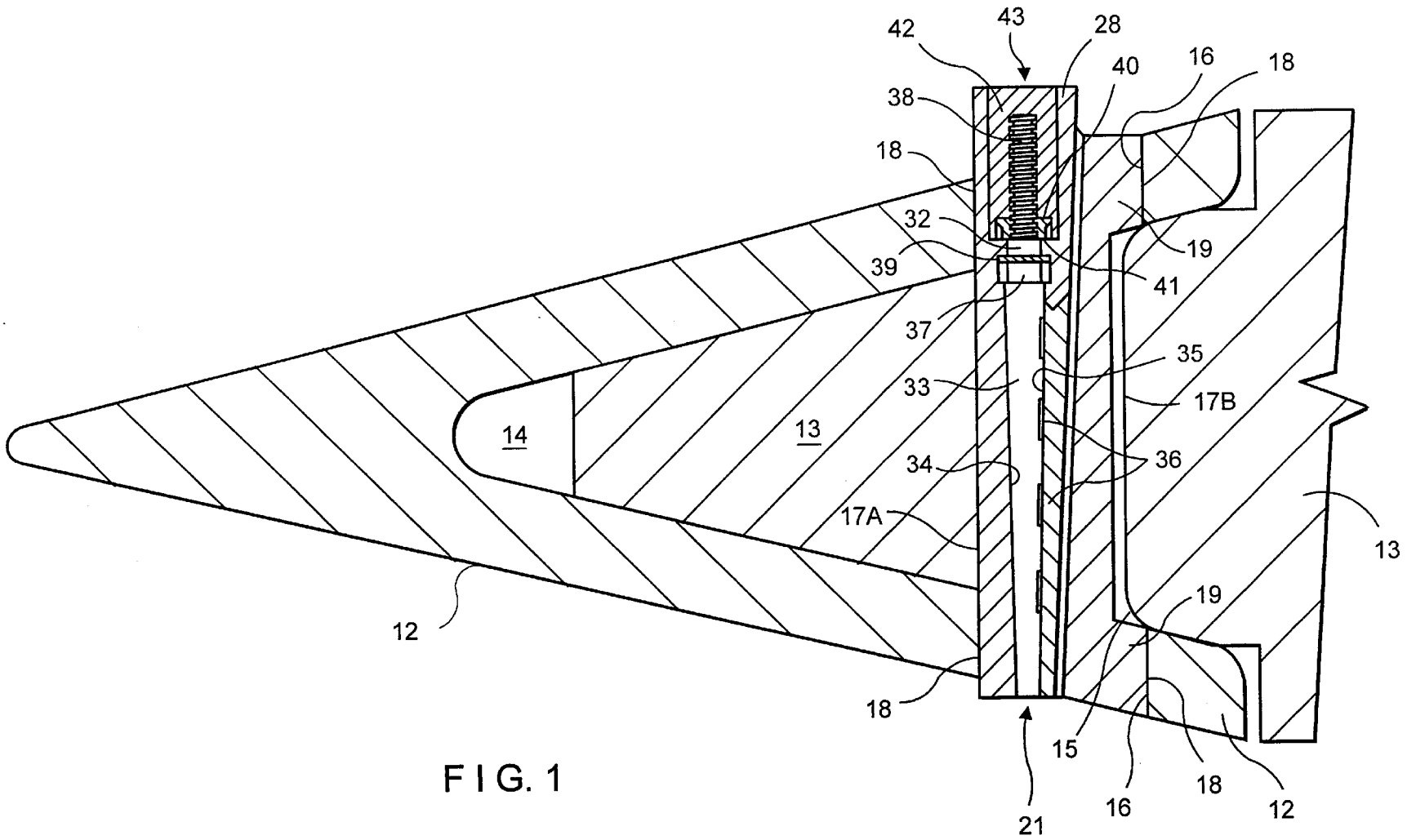
FIG. 1 is a schematic sectioned side elevation of a tooth secured to a projection by means of a wedge assembly.
Figure 2:
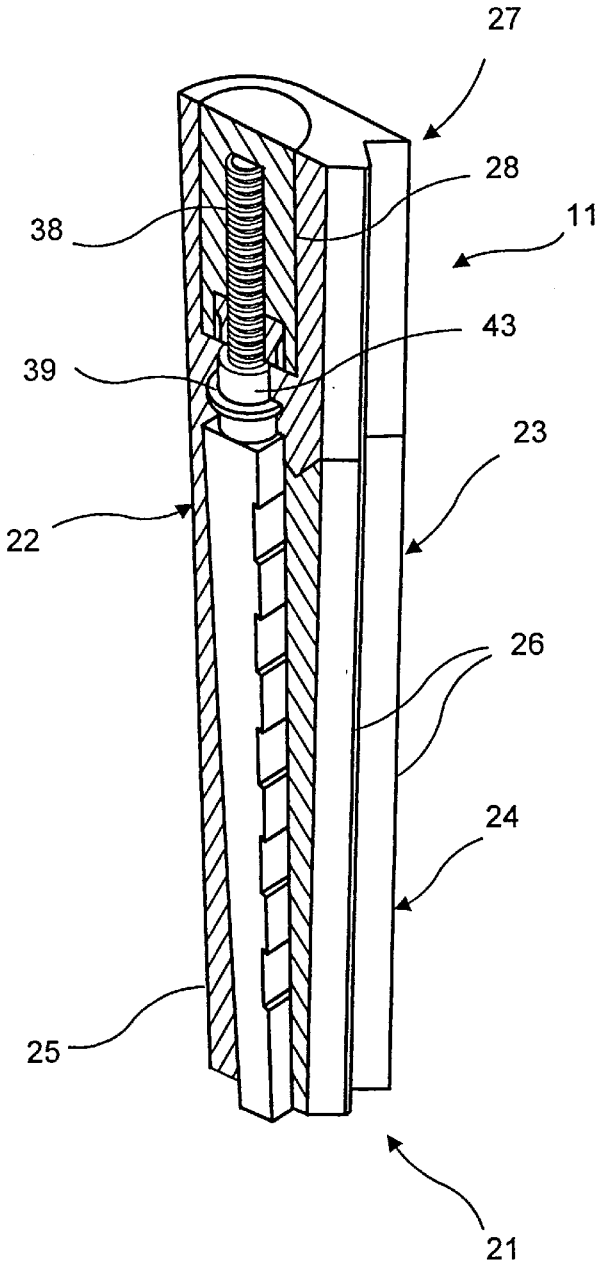
FIG. 2 is a schematic part sectional perspective view of the wedge assembly of FIG. 1.
Figure 3:
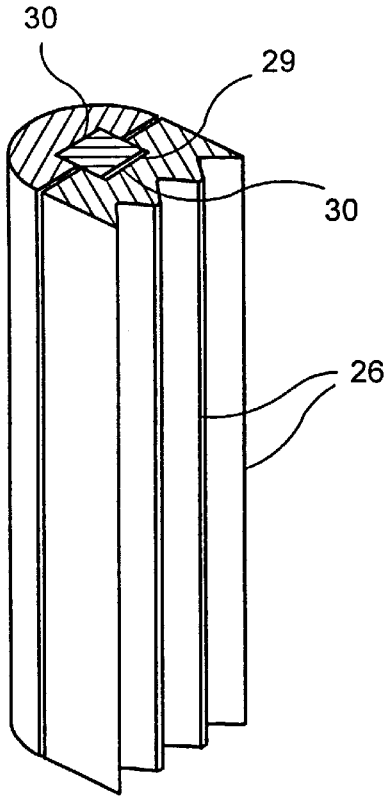
FIG. 3 is a schematic sectioned perspective view of the wedge assembly of FIG. 1.
Figure 4:
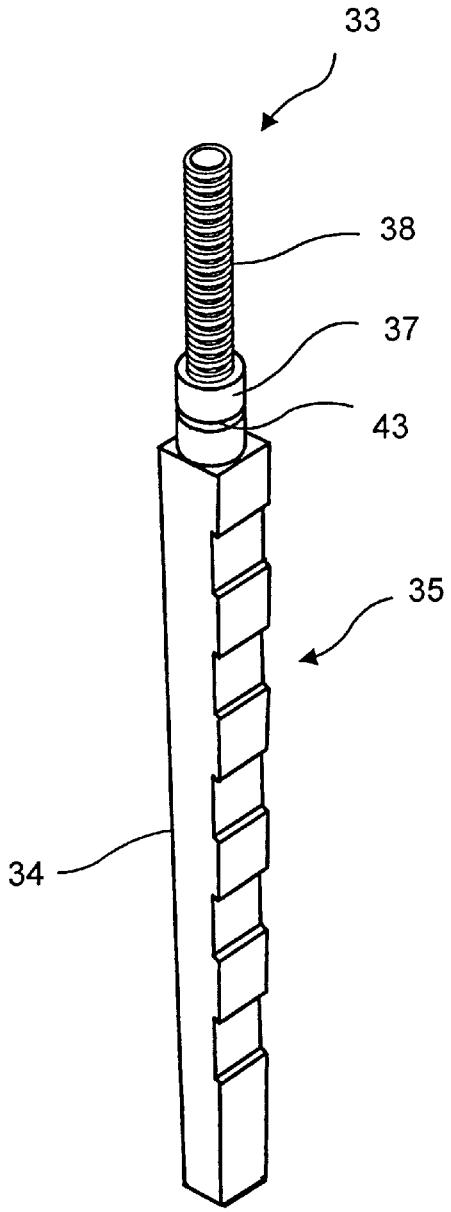
FIG. 4 is a schematic perspective view of a wedge member employed in the wedge assembly of FIG. 1.
Figure 5:
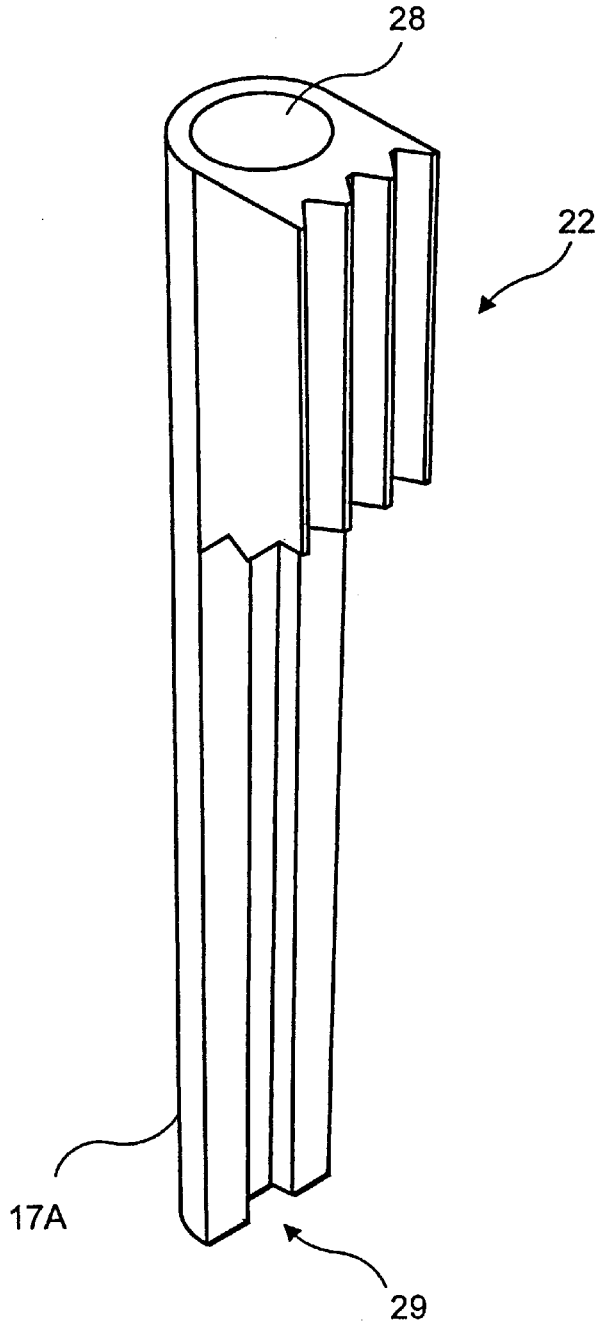
FIG. 5 is a schematic perspective view of a portion of the wedge assembly of FIG. 1.

In the accompanying drawings there is schematically depicted a wedge assembly 10 which in cooperation with a wedge element 11 secures a tooth 12 to the projection 13 of a machine. For example, the projection 13 could be part of a bucket of an earth moving machine or alternatively the projection of a ripper.

The tooth 12 has a tapered cavity 14 extending inwardly from one end and within which the projection 13 extends to support the tooth 12. The projection 13 has a transverse passage 15 which is aligned with passages 16 of the tooth 12. The wedge assembly 10 in conjunction with the wedge element 11 secures the tooth 12 to the projection 13 by being located within the aligned passages 15 and 16. The passage 15 is defined between a pair of generally parallel surfaces 17 while the passages 16 are defined between parallel surfaces 18.

The wedge element 11 includes upper and lower flanges 19 which engage part of the projection 13 to retain the wedge portion 13 in position during installation of the wedge assembly 10. The wedge element 11 is also provided with a wedge surface 20 which defines an acute angle with respect to the surface 17(B). The surface 20 converges with respect to the surface 17(A) toward the end 21 of the assembly 10.

The assembly 10 includes a pair of wedge halves 22 and 23 which provide a pair of wedge surfaces 24 and 25 which converge towards the end 21. The surface 24 is corrugated so as to provide a plurality of ribs 26 which engage the surface 20. The wedge half 22 has a head 27 which is provided with a cavity 28. The surface 25 is arcuate.

The wedge halves 22 and 23 cooperate to provide an internal passage 29 between wedge surfaces 30 and 31 which converge toward the end 21. The passage 29 also includes a neck 32 which extends to the cavity 28.

Located between the wedge halves 22 and 23 so as to be positioned with the passage 29 is a wedge member 33 which has tapered longitudinal surfaces 34 and 35 which cooperate with the surface 30 and 31. The surface 34 is provided with a plurality of transverse indentations 36.

The wedge member 33 is also provided with a shaft portion 37 which passes through the neck 32. The wedge member 33 is also provided with a threaded extremity 38 located within the cavity 28. If so required, a clip or (O) ring 39 may be placed about the shaft portion 37 in the recess 43 to aid in retaining the wedge member 33 in position. A nut 40 is engaged with the threaded extremity 38 and abuts surface 41 of the head 27.

To close the cavity 28, there is provided a cap 42 which may be formed of plastic material. The cap 42 prevents dirt entering the cavity 28 so that the threaded extremity 38 may be engaged by a "puller". The puller is operated so that the wedge member 33 is moved away from the end 21 to permit transverse relative movement of the wedge halves 22 and 23 toward each other. Such transverse movement will reduce the frictional engagement between the assembly 10, the wedge element 11, the tooth 12 and projections 13. This then facilitates removal of the wedge assembly 10 and therefore removal of the wedge element 11 and ultimately the tooth 12 from the projection 13.

To install the assembly 10, a cover would be used to protect the end 43 against impact with the hammer.

The claims defining the invention are as follows:

1. An elongated wedge assembly to secure a tooth to a projection of a machine, the tooth having an aperture to be aligned with an aperture of the projection so that the tooth is secured to the projection by the wedge assembly being located in the aligned apertures, said wedge assembly comprising:

a pair of elongated wedge halves which cooperate to provide a longitudinally extending internal cavity between the wedge halves, the wedge halves providing two longitudinally extending internal surfaces defining said cavity which internal surfaces converge toward one end of said assembly, said wedge halves further providing a pair of longitudinally extending external wedge surfaces which also converge towards said one;

an internal wedge member extending longitudinally of said cavity, said wedge member having wedge surfaces converging toward said one end and cooperating with the converging internal surfaces defining said cavity, said wedge member having a threaded end remote from said end of said cavity whereby to enable gripping of said wedge member to move the wedge member longitudinally in a direction away from said one to enable relative movement of the wedge halves toward each other to facilitate removal of the wedge assembly from engagement with the tooth and projection.

2. The wedge assembly of claim 1, wherein one of said external surface is arcuate.

3. The wedge assembly of claim 2, wherein one wedge half is provided with a head through which said threaded and passes to be at least partly located in a cavity formed in said head.

4. The wedge assembly of claim 3, wherein one of the converging surfaces of said internal wedge member has transversely extending indentations.

5. The wedge assembly of claim 6, wherein one of the converging surfaces of said internal wedge member has transversely extending indentations.

6. The wedge assembly of claim 1, wherein one of said external surface has longitudinally extending ribs.

7. The wedge assembly of claim 6, wherein one wedge half is provided with a head through which said threaded end passes to be at least partly located in a cavity formed in said head.

8. The wedge assembly of claim 7, wherein one of the converging surfaces of said internal wedge member has transversely extending indentations.

9. The wedge assembly of claim 6, wherein one of the converging surfaces of said internal wedge member has transversely extending indentations.

10. The wedge assembly of claim 1, wherein one of said external surfaces is arcuate and the other external surface has longitudinally extending ribs.

11. The wedge assembly of claim 10, wherein one wedge half is provided with a head through which said threaded end passes to be at least partly located in a cavity formed in said head.

12. The wedge assembly of claim 11, wherein one of the converging surfaces of said internal wedge member has transversely extending indentations.

13. The wedge assembly of claim 10, wherein one of the converging surfaces of said internal wedge member has transversely extending indentations.

14. The wedge assembly of claim 1, wherein one wedge half is provided with a head through which said threaded end passes to be at least partly located in a cavity formed in said head.

15. The wedge assembly of claim 14, wherein one of the converging surfaces of said internal wedge member has transversely extending indentations.

16. The wedge assembly of claim 1, wherein one of the converging surfaces of said internal wedge member has transversely extending indentations.

* * * * *